US005433333A

United States Patent [19]

Martell

[11] Patent Number: 5,433,333

[45] Date of Patent: Jul. 18, 1995

[54] STRENGTH ENHANCING CLOSURE HATCH ASSEMBLY FOR ACCESS PORTS IN HIGHWAY UTILITY POLES

[75] Inventor: Dolard A. Martell, Newberry, S.C.

[73] Assignee: Shakespeare Company, Newberry, S.C.

[21] Appl. No.: 18,056

[22] Filed: Feb. 16, 1993

[51] Int. Cl.[6] ..... B65D 45/00

[52] U.S. Cl. ..... 220/243; 220/251

[58] Field of Search ..... 220/243, 251, 314; 138/89, 90, 92; 292/260; 174/66; 411/427, 432

[56] References Cited

U.S. PATENT DOCUMENTS

| | | | |
|---|---|---|---|
| 194,402 | 8/1877 | Barns | 220/251 |
| 1,456,314 | 5/1923 | Key | 220/251 |
| 3,094,238 | 6/1963 | Davidson | 220/251 |
| 3,194,427 | 7/1964 | Mullett et al. | 220/251 X |
| 4,166,537 | 9/1979 | Fortunato | 220/251 X |

*Primary Examiner*—Allan N. Shoap
*Assistant Examiner*—Christopher J. McDonald
*Attorney, Agent, or Firm*—Renner, Kenner, Greive, Bobak, Taylor & Weber

[57] ABSTRACT

This disclosure relates to a closure hatch assembly for the access port of a utility pole. The access port has opposed, lateral edges and opposed, longitudinal edges. The hatch plate has a closure wall that is adapted to close the access port. The closure wall has a reverse face with laterally spaced protuberances extending outwardly therefrom. Opposed walls on the protuberances define a channel therebetween, and a bracket member is receivable within the channel. The bracket member presents longitudinally spaced bearing surfaces that are adapted operatively to engage the opposed longitudinal edges of the access port. The bracket member also has laterally spaced walls that are receivable within the channel in sufficiently close proximity with the opposed walls that define the channel in order to transfer compressive forces therebetween. A fastener releasably secures the bracket member within the channel and thereby mount the bracket assembly to the utility pole.

4 Claims, 4 Drawing Sheets

STRENGTH ENHANCING CLOSURE HATCH ASSEMBLY FOR ACCESS PORTS IN HIGHWAY UTILITY POLES

TECHNICAL FIELD

The present invention relates generally to highway utility poles in the nature of those employed to support lights, signs, traffic signals and the like, alongside roads and highways. More particularly, the present invention relates to closure assemblies for the service access ports provided in highway utility poles. Specifically, the present invention relates to access port closure assemblies that enhance the bending strength of the utility pole with which they are employed.

BACKGROUND OF THE INVENTION

Originally, highway utility poles were wood, steel or concrete, but such poles provided rigid resistance to impact from vehicles. As a result, when a vehicle struck such a utility pole the occupants of the vehicle were commonly subjected to excessive deceleration forces that often result in extremely severe, or even fatal, injury. This result led to the development of highway utility pole structures which greatly reduced not only the deceleration forces but also the high incidence of sever, or fatal, injuries. In fact, utility poles utilized on federally funded highway projects must now meet rigid breakaway performance criteria. The presently required breakaway performance criteria are set forth in the American Association of State Highway Transportation Officials Publication entitled "Standard Specifications for Structural Supports for Highway Signs, Luminaries and Traffic Signals 1985."

To meet these requirements, highway utility poles have been constructed of lightweight materials such as aluminum and fiber reinforced plastic (FRP). FRP materials—typically reinforced with fiberglass—have proven to be particularly desirable not only in meeting the breakaway performance criteria, but also because such utility poles are not electrically conductive. Thus, when FRP poles are broken the pole itself can not serve as a conductor. This is a definite advantage attributable to the FRP utility pole.

Electrical service is frequently provided to utility poles by underground lines, and the hollow interior of even the non-conductive utility poles serves as the path along which the electrical service lines may extend to provide the desired electrical power to lights, or the like, mounted at the top of the pole, or to whatever height required. An access port is typically provided in the utility pole, normally at a height which can be reached by a worker standing on the ground or on a relatively short ladder. Such access ports are each provided with a closure hatch assembly that employs an adjustable mounting means, such as a screw and bracket, or bar, to secure the closure hatch, or plate, in a position over, or within, the access port. The bracket engages the interior surface of the hollow pole to provide a base into which the screw can be tightened in order demountably to secure the closure hatch in position.

The presence of an access port, however, has been found to reduce the bending strength of the utility pole at that location where the port penetrates the wall of the utility pole, and that location is normally above that at which the pole is intended to fail when struck by a vehicle. The reduced bending strength of the utility pole results not only by virtue of the absence of wall material at the location of the port but also because most access ports are configured such that stress concentrations are induced, particularly at any locations around the perimeter of the access port which presents a relatively sharp corner. A significant reduction of stress concentrations can be accomplished by eliminating any vestige, of sharp corners, and by providing rounded surfaces to define the perimeter of the access port. Even so, the very existence of the access port has heretofore resulted in an unavoidable reduction in the bending strength of the pole at the location of the access port.

Because of this tendency of the utility poles to buckle in proximity to the location of the access ports when subjected to compressive stresses, standards which delineate the magnitude of the bending stresses which utility poles must withstand have been imposed upon utility poles used in conjunction with federally funded highways. In general, such poles must be capable of withstanding two times the maximum compressive loading imposed on the pole by the maximum anticipated wind load calculated in conformity with ANSI C-136.2 standards. The specific testing routine is also delineated by that accepted governmental standard.

The specific tests have, heretofore, been difficult to satisfy without adding undue wall thickness, and the concomitant additional weight, to FRP utility poles.

SUMMARY OF THE INVENTION

It is, therefore, a primary object of the present invention to provide an improved closure hatch assembly for service access ports of the type provided in highway utility poles.

It is another object of the present invention to provide an improved closure hatch assembly, as above, for utility poles which tends to obviate the reduction in bending strength that has heretofore been associated with the provision of access ports in FRP utility poles.

It is a further object of the present invention to provide an improved closure hatch assembly, as above, which incorporates a unique bracket member that serves to enhance the bending strength of FRP utility poles with which the closure hatch assembly is employed, and without increasing the wall thickness or the weight of the pole.

It is still another object of the present invention to provide an improved closure hatch assembly, as above, wherein the bracket member portion of the hatch assembly cooperates not only directly with the access port but also indirectly therewith through the hatch plate in order to serve as a load bearing member that enhances the bending strength of the utility pole with which the closure plate assembly is employed.

These and other objects of the invention, as well as the advantages thereof over existing and prior art forms, which will be apparent in view of the following detailed specification, are accomplished by means hereinafter described and claimed.

In general, the present invention provides a hatch plate that is cooperatively secured to the utility pole in order selectively to dose the access port provided in the utility pole. The access port has opposed, lateral edges and opposed, longitudinal edges.

The hatch plate has a closure wall that is adapted to close the access port. The closure wall has a reverse face with laterally spaced protuberances extending outwardly therefrom. Opposed walls on the protuberances define a channel therebetween, and a bracket member is receivable within the channel.

The bracket member presents longitudinally spaced bearing surfaces that are adapted operatively to engage the opposed longitudinal edges of the access port. The bracket member also has laterally spaced walls that are receivable within the channel in sufficiently close proximity with the opposed walls that define the channel in order to transfer compressive forces therebetween.

Fastener means releasably secure the bracket member within the channel and thereby mount the bracket assembly to the utility pole.

One exemplary embodiment of an access port closure hatch assembly embodying the concepts of the present invention, and particularly adapted for use with an electrical utility pole, is shown by way of example in the accompanying drawings and is described in detail without attempting to show all of the various forms and modifications in which the invention might be embodied; the invention being measured by the appended claims and not by the details of the specification.

The forgoing objects and advantages will be more apparent from the following detailed description of an exemplary embodiment depicted in the drawings.

DESCRIPTION OF AN EXEMPLARY EMBODIMENT

Figure 1:
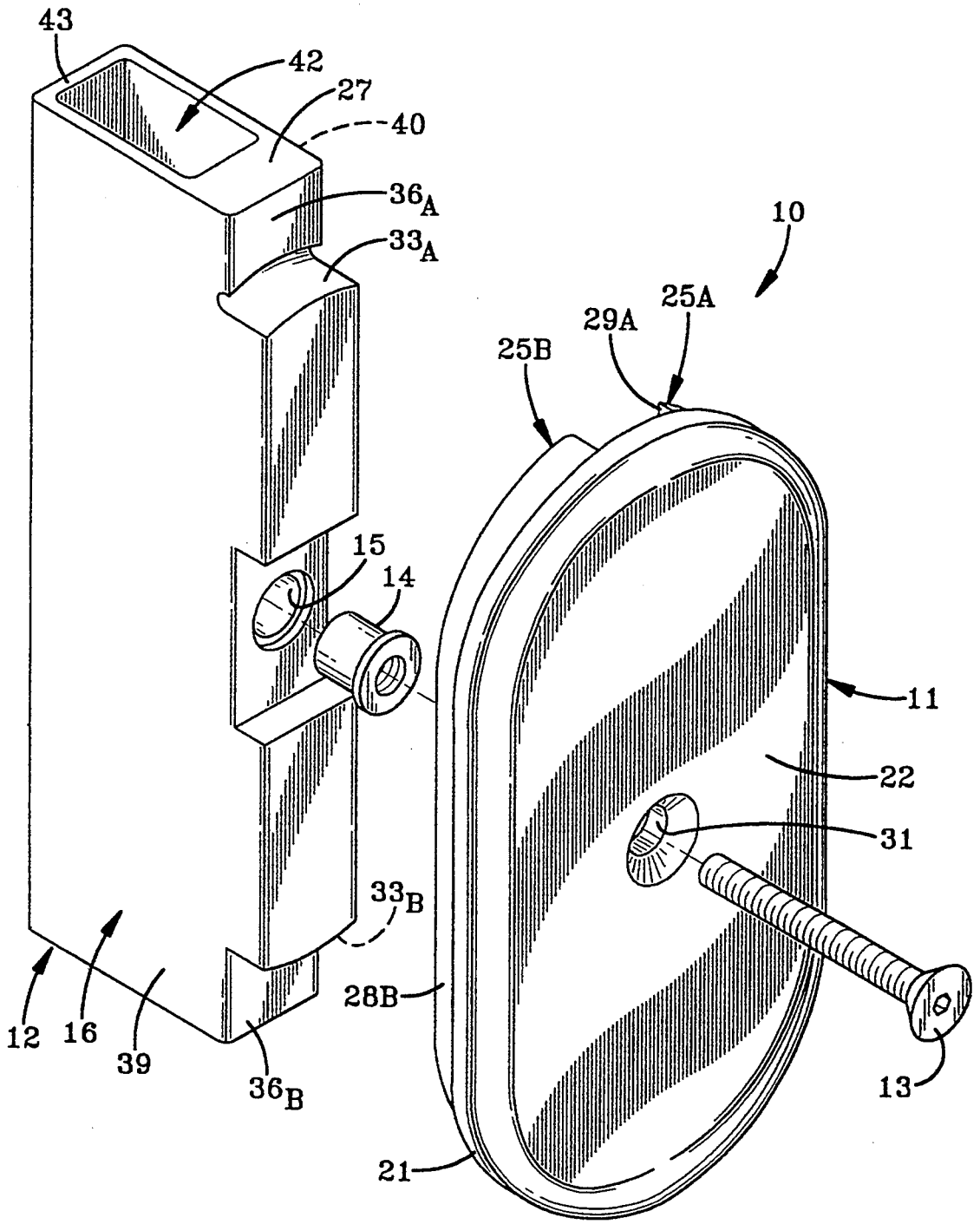
FIG. 1 is an exploded perspective view of a closure hatch assembly embodying the concepts of the present invention.

A closure hatch assembly embodying the concepts of the present invention, as depicted in FIGS. 1–4 of the attached drawings, is identified generally by the numeral 10. By way of a brief overview, the improved closure hatch assembly 10 utilizes a hatch plate 11, a unique bracket member 12, a threaded fastener, or screw, 13 and a plug 14 that is secured within a bore 15 in the body portion 16 of the bracket member 12.

The assembly 10 is used to close an access port 18 (FIGS. 3 and 4) by which authorized personnel can gain ready access to the hollow interior 19 of a highway utility pole 20. The hatch plate 11 may be constructed of an FRP such as fiberglass or other commercially available composite plastic material that is identical to, or compatible with, the FRP material from which the utility pole 20 is made. As such, even the currently available closure plates may be employed in the improved assembly 10. This approach can save considerable resources by allowing existing assemblies to be readily modified to accomplish the objects of the present invention.

Figure 2:
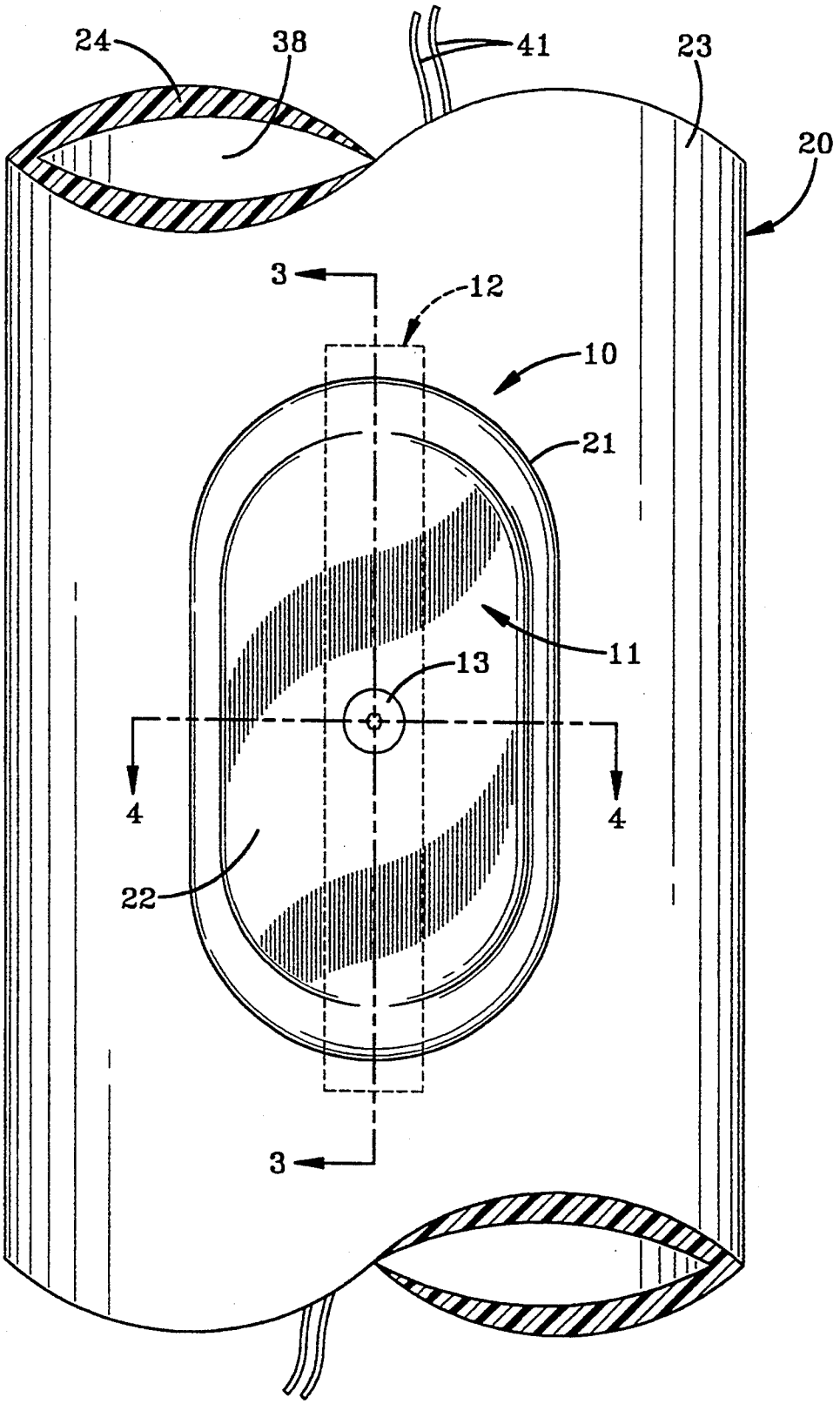
FIG. 2 is an elevational view of the closure hatch assembly depicted in FIG. 1 installed to close an access port in a utility pole.
Figure 4:
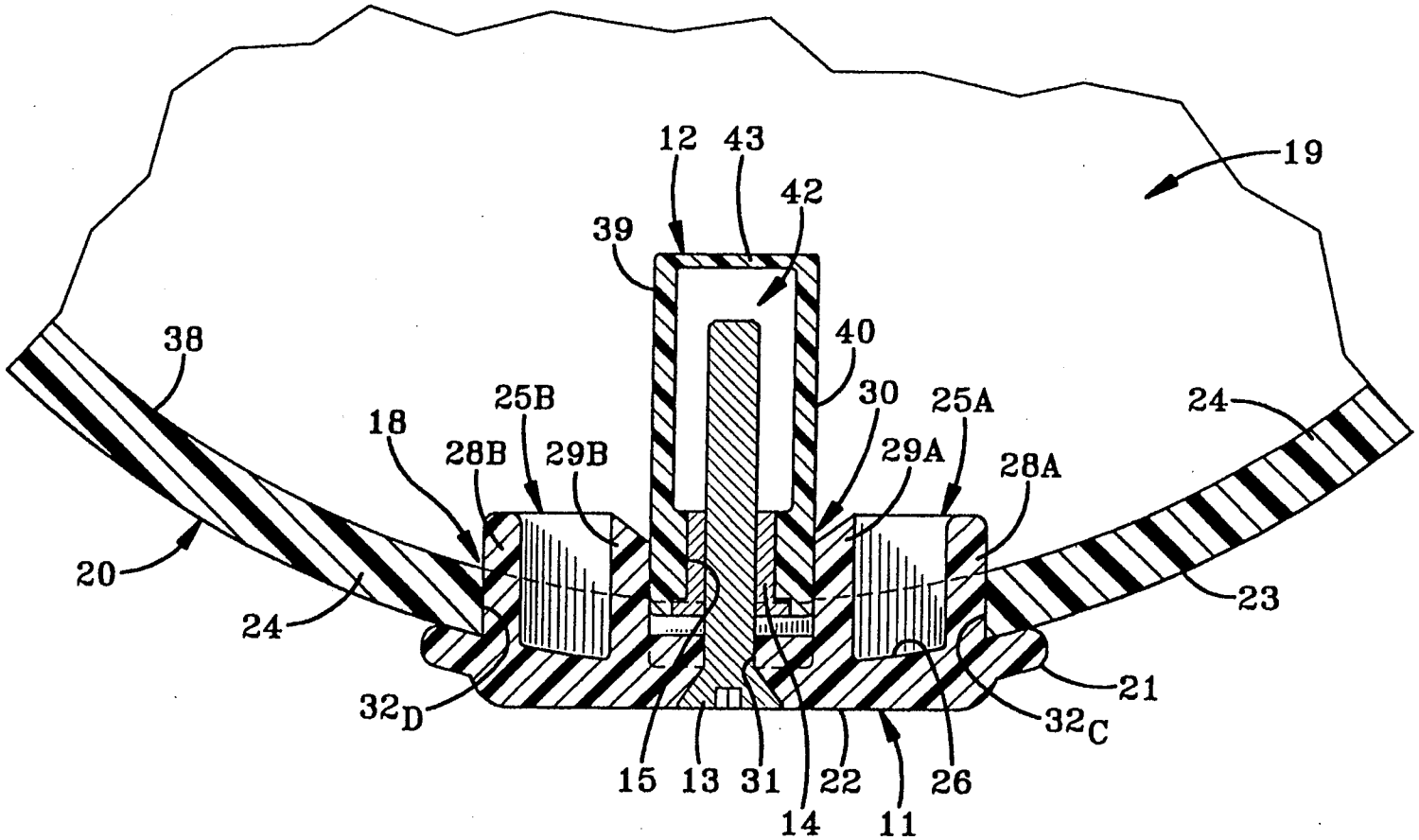

The hatch plate 11 is generally oval, or perhaps more accurately, has a racetrack-shaped, outer periphery, as can be seen in FIGS. 1 and 2. A lip 21 extends outwardly along, and defines, the entire outer circumference of the closure wall 22 presented by the hatch plate 11. In addition, the closure wall 22 and the outer lip 21 are transversely curved to engage the cylindrical outer surface 23 on the wall 24 of the utility pole 20 (FIG. 4). A pair of laterally spaced protuberances 25A and 25B extend outwardly from the reverse face 26 on the closure wall 22 of the hatch plate 11. The laterally outer walls 28A and 28B of each protuberance 25 follow the generally elliptical, or racetrack configuration, of the lip 21 and are offset from the periphery of the lip 21 to cooperate therewith and thereby define an aligning, or locating, means by which to position the hatch plate 11 properly with respect to a corresponding elliptical aperture that defines the access port 18 provided in the wall 24 of the highway utility pole 20. The desired interaction between the outer walls 28A and 28B with the access port 18 will be hereinafter more fully described.

As previewed in the previous paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general designation of that structural member, component or arrangement. Thus, there are at least two protuberances which are generally identified by the numeral 25, but the specific, individual protuberances are, therefore, identified as 25A and 25B in the specification and on the drawings. Similarly, portions of a common structural element will, where deemed appropriate for clarity, be designated with a letter subscript employed in conjunction with the identifying numeral for that element. These suffix conventions shall be employed throughout the specification.

The laterally spaced, opposing walls 29A and 29B of the respective protuberances 25A and 25B delineate a recess, or bracket receiving channel, 30 therebetween. The bracket member 12 is snugly receivable within the recess, or channel, 30 and may be secured therein by a fastener in the nature of the screw 13 that extends through a bore 31 which penetrates the closure wall 22 of the hatch plate, 11 medially between the protuberances 25A and 25B. The bracket member 12 may also preferably be made of an FRP. Here, too, most of the commercially available fiber reinforced plastic composites will perform satisfactorily.

The bracket member 12 is shown as having a substantially rectangular cross section. At least a portion of the bracket member 12 must serve as a longitudinal and lateral compressive load bearing member. As such, the bearing portion 27 of the bracket member 12 may need to be solid, as shown. However, that requirement may be determined mathematically in view of the compressive strength required to be achieved by having the bracket member 12 engage, and extend between, the opposed edges $32_A$ and $32_B$ (FIG. 3) that define the apogee of the elliptical access port 18.

Figure 3:
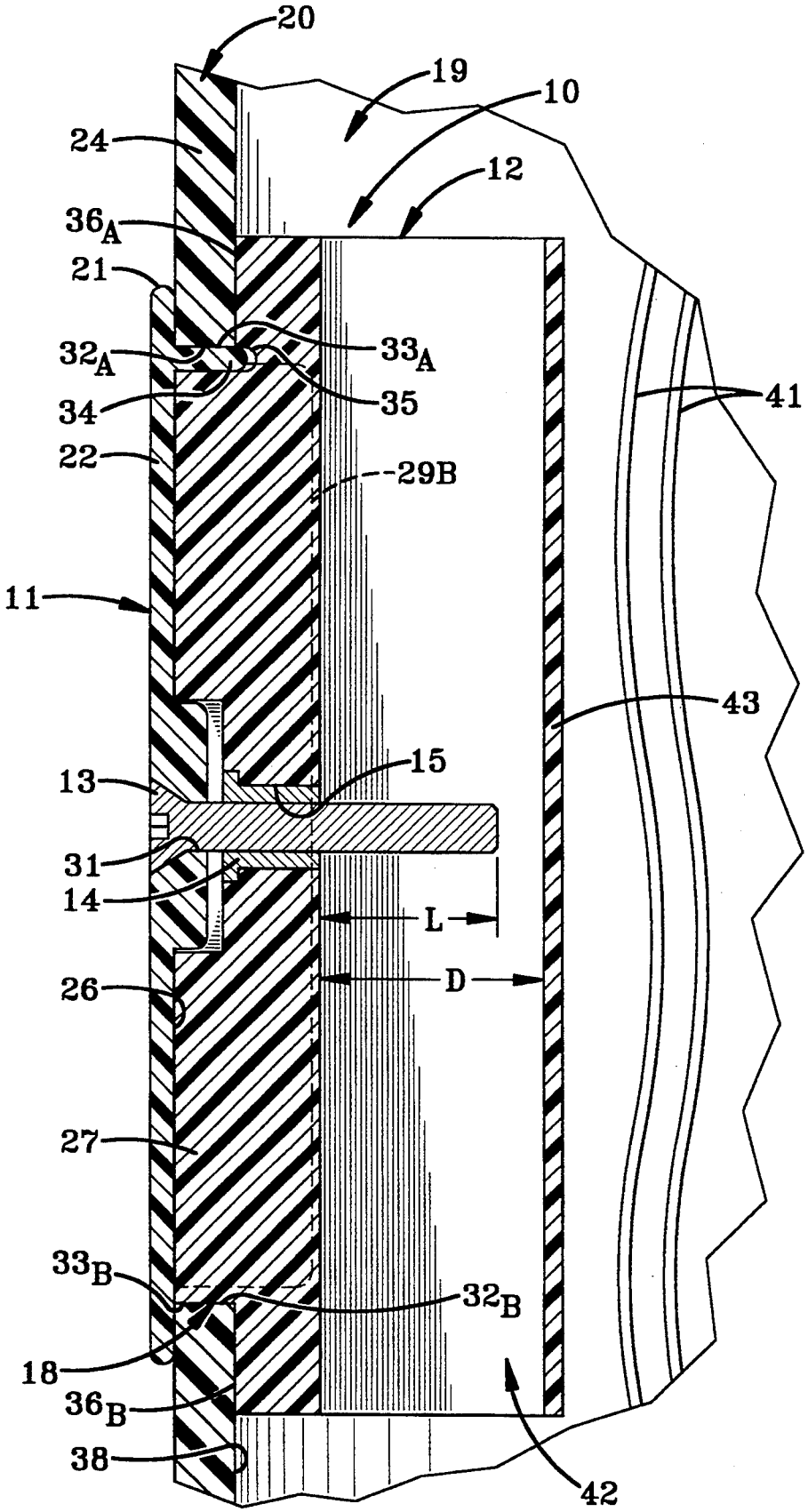
FIG. 3 is an enlarged, longitudinally oriented, sectional view taken substantially along line 3—3 of FIG. 2; and, FIG. 4 is an enlarged, transverse, sectional view taken substantially along line 4—4 of FIG. 2.

One way by which to provide the necessary bearing surfaces is to notch the opposite ends of the bracket member 12. As shown, this notching provides longitudinally spaced, oppositely directed, bearing surfaces $33_A$ and $33_B$ which operatively engage the opposed edges $32_A$ and $32_B$, respectively, of the access port 18. The bearing surfaces $33_A$ and $33_B$ may directly engage the opposed edges $32_A$ and $32_B$, as clearly represented by the direct engagement of bearing surface $33_B$ with edge $32_B$ of access port 18, as depicted in FIG. 3. On the other hand, as is also depicted in FIG. 3, the bearing surface $33_A$ may be spaced with respect to the edge $32_A$ in order to accommodate a transverse rib 34 that commonly extends between the laterally spaced protuberances 25 in prior art hatch plates 11. Hence, when one is adapting prior art closure assemblies to accomplish the objects of the present invention, a recess 35 should be provided at the intersection of each bearing surface 33 and the hereinafter described seating surface 36 associated with the bearing surface 33. In either arrangement it is preferable to shape the bearing surfaces 33 to conform to the shape of the edges 32. As shown in FIG. 1, the bearing surfaces 33 may, therefore, be curvilinear.

The seating surfaces $36_A$ and $36_B$ which engage the radially inner surface 38 on the wall 24 of the utility pole 20 when the closure hatch assembly 10 is secured to close the access port 18, as will be hereinafter more fully explained, are provided as a result of the aforesaid notching.

The lateral compressive strength imparted to the pole 20 by the subject closure hatch assembly 10 does not occur as a result of any direct engagement between the opposed edges $32_C$ and $32_D$ that define the perigee of the elliptical access port 18 and the bracket member 12. Rather, the outer walls 28A and 28B of the protuberances 25A and 25B engages the opposed edges $32_C$ and $32_D$ of the access port 18. In addition, and as is also depicted in FIG. 4, the opposed walls 29A and 29B on the spaced, parallel protuberances 25A and 25B—which define the side walls of the groove, or channel, 30—are preferably disposed to lie in close proximity to the side walls 39 and 40 of the bracket member 12 when the closure hatch assembly 10 is secured on the utility pole 20. This complementary relationship of the bracket member 12 within the groove 30 as well as the complementary relationship of the protuberances 25 with the access port 18 assures that any lateral compressive forces applied by the opposed edges $32_C$ and $32_D$ of the access port 18 to the protuberances 25 will be transmitted to, and resisted by, the bracket member 12.

This same close proximity will also serve to prevent any wires, such as those identified at 41, within the utility pole 20 from coming into contact with any portion of the screw 13 which may extend between the hatch plate 11 and the bracket member 12. This aspect of the structure disclosed herein is the subject of a presently pending U.S. patent application, Ser. No. 07/980,922, filed on Nov. 24, 1992, and directed to a "Closure Hatch Assembly for an Access Port in a Highway Utility Pole" that is assigned to the assignee of the subject application.

To achieve the results accomplished by the invention disclosed in the copending application one may also employ a hollow cavity 42 that extends the full longitudinal extent of the bracket member 12 so that the screw 13 will not penetrate beyond the base wall 43 of the bracket member 12.

To attach the closure hatch assembly 10 to the pole 20, the hatch plate 11 is loosely secured to the bracket member 12 by the screw 13. That is, the screw 13 is threaded into the plug 14 with only two or three turns of the threads. This loose connection between the hatch plate 11 and the bracket member 12 permits the bracket member 12 to be "button-holed" through the access port 18 and then be longitudinally displaced so that the bracket member 12 will span the access port 18 to permit the seating surfaces $36_A$ and $36_B$ to engage the interior surface 38 of the pole 20 on opposite sides of the access port 18 without interference from the hatch plate 11. With the bracket member 12 and the groove, or channel, 30 in the hatch plate 11 disposed in alignment, the screw 13 is further tightened into the plug 14, thereby securing the protuberances 25 within the access port 18 and simultaneously securing the bracket member 12 within the groove 30. The resulting pressure applied by the lip 21 to the cylindrical outer surface 23 of the utility pole 20 in opposition to the opposed pressure applied by the seating surfaces $36_A$ and $36_B$ on the bracket member 12 to the cylindrical interior surface 38 of the utility pole 20 holds the closure hatch assembly 10 securely in position to close the access aperture 18.

The hollow cavity 42 must have a depth dimension "D" that is greater than that length "L" of the screw 13 that extends beyond the plug 14 when the assembly 10 is secured to the utility pole 20. This geometric relation prevents the screw 13 from protruding through the base wall 43 of the bracket member 12, thus further precluding contact between the screw 13 and any wires 41.

The foregoing description of an exemplary embodiment of the invention has been presented for the purposes of illustration and description. It is not intended to be exhaustive or to limit the invention to the precise form disclosed. Obvious modifications, or variations, are possible in light of the above teachings. The embodiment was chosen and described to provide the best illustration of the principles of the invention and its practical application in order to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

As should now be apparent, the present invention not only teaches that a closure hatch assembly—for the access port of a utility pole—embodying the concepts of the present invention not only enhances the bending strength of the utility pole with which it is employed but also accomplishes the other objects of the invention.

I claim:

1. A hatch assembly for closing an access port in a hollow utility pole and for simultaneously enhancing the bending strength of the utility pole employing the hatch assembly, the utility pole having an inner surface, and the access port having opposed lateral edges and opposed longitudinal edges, said hatch assembly comprising:

a hatch plate;

said hatch plate having a closure wall adapted to close the access port;

said closure wall having a reverse face; laterally spaced protuberances extending outwardly from said reverse face;

opposed walls on said laterally spaced protuberances defining a channel therebetween;

a bracket member receivable within said channel; said bracket member having longitudinally spaced bearing surfaces and seating surfaces;

said seating surfaces on said bracket member engageable with the inner surface of the utility pole;

said bearing surfaces on said bracket member disposed operatively to engage the opposed longitudinal edges of the access port;

a fastener means for releasably securing said bracket member to the hatch plate with said bracket member received in said channel and said seating surfaces engaging the inner surface of the utility pole in order to mount said bracket assembly to the utility pole; and, said bracket member having laterally spaced walls that are receivable within said channel in sufficiently close proximity with said opposed walls defining a channel between said protuberances to transfer compressive forces therebetween.

2. A hatch assembly, as set forth in claim 1, wherein:

said bearing surfaces are curvilinear to engage the access port.

3. A hatch assembly, as set forth in claim 2; wherein;

each said longitudinally spaced seating surface is conjoined with said longitudinally spaced bearing surface at an intersection;

a recess is formed in said seating surface at said intersection of said seating surface with said bearing surface to receive a rib presented from said hatch plate.

4. A hatch assembly, as set forth in claim 3, wherein:

said fastener means has a predetermined length; and, said bracket member is hollow and has an interior dimension sufficient to receive said fastener means without exposure to the interior of the utility pole.

* * * * *